US007374503B2

(12) United States Patent
Mullins

(10) Patent No.: US 7,374,503 B2
(45) Date of Patent: May 20, 2008

(54) WAVABLE BASKETBALL BACKBOARD AND RIM

(76) Inventor: Hewitt Mullins, 1058 Broadway, 2nd floor, Brooklyn, NY (US) 11221

( * ) Notice: Subject to any disclaimer, the term of this patent is extended or adjusted under 35 U.S.C. 154(b) by 291 days.

(21) Appl. No.: 11/240,302

(22) Filed: Sep. 30, 2005

(65) Prior Publication Data

US 2007/0078033 A1 Apr. 5, 2007

(51) Int. Cl.
*A63B 63/08* (2006.01)

(52) U.S. Cl. ..... 473/479; 273/317; D21/400; 473/481

(58) Field of Classification Search ..... 473/481, 473/479, 507; D3/1–4; D21/419, 420; 273/330, 273/348

See application file for complete search history.

(56) References Cited

U.S. PATENT DOCUMENTS

| | | | | | |
|---|---|---|---|---|---|
| 2,570,860 | A | * | 10/1951 | Redding | 273/329 |
| D174,327 | S | * | 3/1955 | Jonesi | D21/466 |
| 3,907,297 | A | * | 9/1975 | Di Leva | 473/507 |
| 4,000,898 | A | * | 1/1977 | Cooter | 473/512 |
| 4,801,142 | A | | 1/1989 | Friesen | |
| D307,040 | S | * | 4/1990 | Helalian | D21/466 |
| D326,483 | S | * | 5/1992 | Willis | D21/466 |
| 5,149,086 | A | | 9/1992 | Ziff | |
| 5,192,080 | A | | 3/1993 | Duncan | |
| D344,558 | S | | 2/1994 | Livera et al. | |
| 5,390,914 | A | | 2/1995 | Schroeder | |
| 5,413,328 | A | | 5/1995 | Glancey et al. | |
| 5,829,751 | A | * | 11/1998 | Willis | 273/330 |
| D423,575 | S | * | 4/2000 | Lowe | D19/36 |
| D469,600 | S | * | 2/2003 | Scalise | D3/3 |
| 6,746,348 | B2 | * | 6/2004 | Barnes et al. | 473/433 |

* cited by examiner

*Primary Examiner*—Eugene Kim
*Assistant Examiner*—M. Chambers
(74) *Attorney, Agent, or Firm*—Steven Horowitz

(57) ABSTRACT

When a rod extending out of the bottom of a hollow rigid plastic trunk encasing a collapsible basketball backboard is pushed up, the backboard comes out of the top of the trunk and opens and a rim rotates 90 degrees to an "up" position perpendicular to the trunk. A pulley system inside the trunk, one end of which is connected to the push rod, controls rotation of a hinge attached to a rim, the hinge sitting in an opening in the top of the trunk. When the rod is pulled, the planar segments of the backboard fold to a point one behind the other and go downward to fit into the trunk and the hoop moves to a "down" position. In open position the backboard segments fan out. The rod has a V-shaped attachment piece connecting the top of the rod to the common bottom border of the backboard.

15 Claims, 6 Drawing Sheets

WAVABLE BASKETBALL BACKBOARD AND RIM

FIELD OF THE INVENTION

The field of this invention is devices held by fans during sports activities to distract players, and more particularly, such devices that hand-held and used in basketballs games by basketball fans.

BACKGROUND OF THE INVENTION AND DISCUSSION OF THE PRIOR ART

During basketball games, fans use thunder sticks to wave at players of the opposing teams during free throw attempts. The fans sit behind the areas facing the player doing a free throw and wave two air filled cylindrical balloons made of canvas in order to distract the player. These thunder sticks, as they came to be called, are simple and limited in value. They do not extend width-wise much more than the width of the fan's body.

SUMMARY OF THE PRESENT INVENTION

A fan waves a simulated basketball backboard including a rim and net. The backboard, made of parallel planar segments, emerges out of the top of a rigid plastic trunk when a push rod extending out of the bottom of the trunk is pushed up and fans out into an "open" position. Simultaneously the rim/hoop, which had been in "down" position adjacent the side of the trunk rotates 90 degrees to an "up" position perpendicular to the trunk. Rotation of the hoop is controlled by a two wheel pulley system inside the trunk that controls a hinge sitting in a groove carved out of the top front portion of the trunk, the groove bounded by brackets on each side and the horizontal pin of the hinge fitting into slots on each side of the opening.

When the rod extending our of the bottom of the trunk is pulled down, the parallel planar segments of the backboard go one behind the other and go downward to fit into the trunk and the hoop moves to a "down" position. In open position the backboard segments fan out. The rod has a V shaped attachment piece connecting the top of the rod to the common bottom border of the backboard. A spring keeps the legs of the V shaped attachment piece together (which helps causes the entire backboard to move downwardly into the empty hollow space of the trunk housing when the push rod is pulled down).

IMPORTANT OBJECTS AND ADVANTAGES

Among the following objects and advantages of the present invention that may apply to certain embodiments are:

(1) to provide a collapsible basketball backboard assembly that allows a fan at a game to distract basketball players of the opposing team during free throw attempts;

(2) to provide a collapsible basketball backboard assembly that is portable;

(3) to provide a collapsible basketball backboard assembly that can be fitted with a voice mechanism that makes sounds;

(4) to provide a collapsible basketball backboard assembly that can be colored with the colors of particular teams;

(5) to provide a collapsible basketball backboard assembly that is wavable manually;

(6) to provide a collapsible basketball backboard assembly that is activated by simply pushing a rod upward;

(7) to provide a collapsible basketball backboard assembly that is lightweight enough for one person to comfortable wave;

(8) to provide a collapsible basketball backboard assembly that is of simple construction;

(9) to provide a collapsible basketball backboard assembly that can be controlled by simply pulling down and pushing up a push rod extending out of a trunk;

(10) to provide a collapsible basketball backboard assembly that when activated opens up a basketball backboard;

(11) to provide such a collapsible basketball backboard assembly that simultaneously rotates a rim and net to a position substantially perpendicular to the backboard;

(12) to provide a collapsible basketball backboard assembly that includes a backboard made of segments that when connected together in open position have the appearance of a backboard;

(13) to provide a means for distracting the opposing team's basketball players in a way that is easy to operate;

(14) to provide a collapsible basketball backboard assembly that functions as a distraction means that is more effective than so-called "thunder sticks";

(15) to provide a collapsible basketball backboard assembly that; is more basketball-oriented than "thunder sticks"; and

(16) to provide a collapsible basketball backboard assembly that when needed for use can be made broad and effective enough to distract attention yet at the same time when not in use can be made narrow, small and inconspicuous enough to be suitable for a fan to carry at his or her seat.

DETAILED DESCRIPTION OF THE PREFERRED EMBODIMENT

Figure 1:
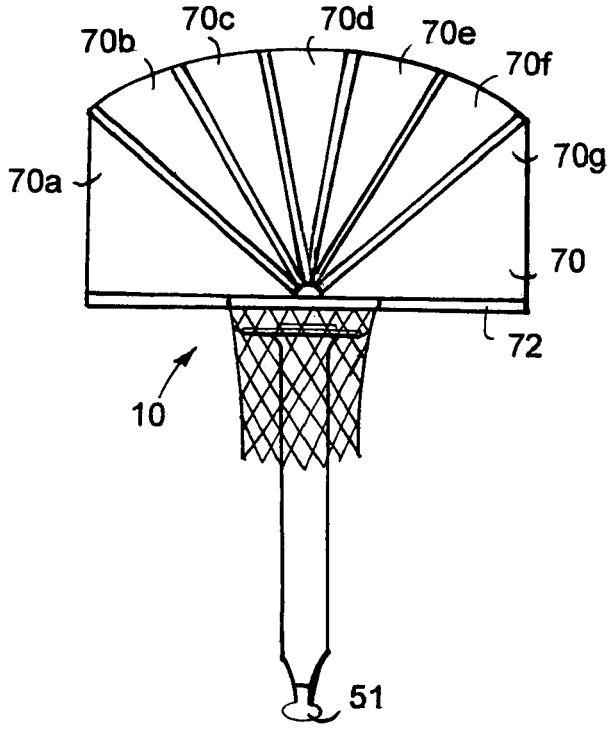
FIG. 1 is a front view of the collapsible basketball backboard assembly of the present invention in an open position.

The apparatus of the present invention will now be illustrated by reference to the accompanying drawings. The collapsible basketball backboard assembly of the present invention has been assigned reference numeral 10. Other elements have been assigned the reference numerals referred to below.

Figure 8:
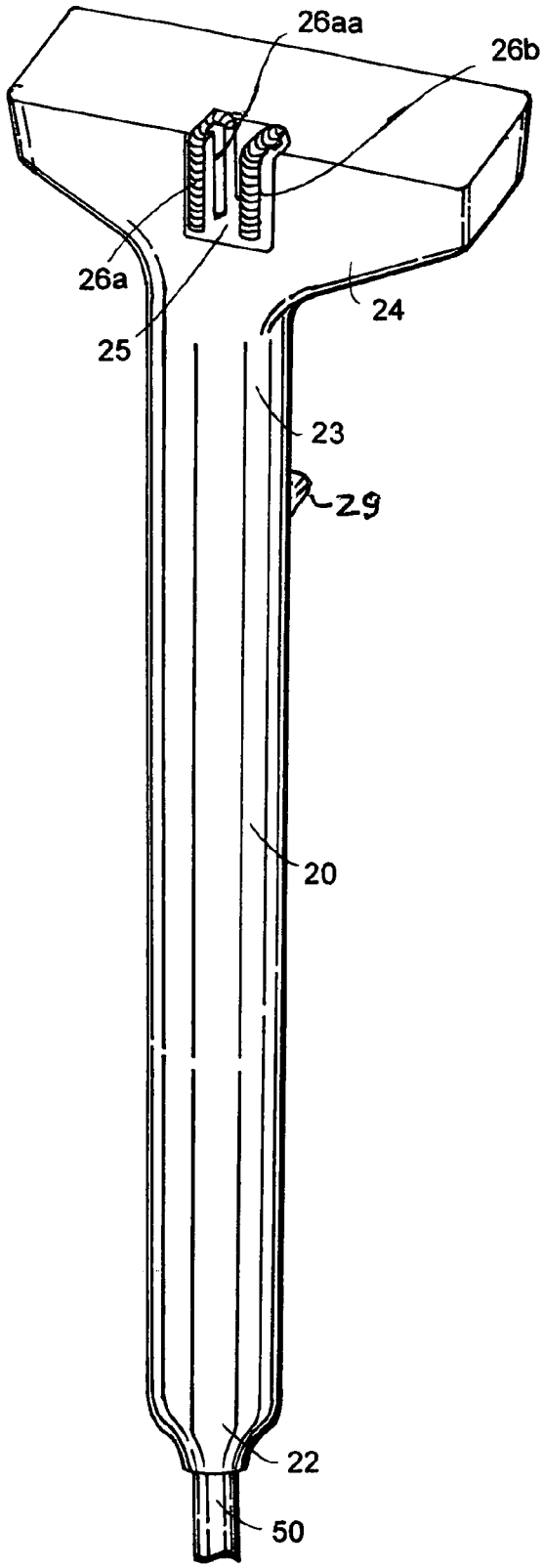
FIG. 8 is a perspective view of the trunk used in the assembly of the present invention partly broken away at the top to show the opening for the hinge.

As seen from FIGS. 1-8, a preferred embodiment of the collapsible basketball backboard assembly 10 of the present invention is provided. In accordance with this preferred embodiment, collapsible basketball backboard assembly 10 includes. As can be seen from FIG. 1-8, a collapsible basketball backboard assembly 10 comprises a hollow trunk 20 having a bottom end 22 and a top end 24, the top end 24 is attached to a rotation control structure 30. Trunk 20 is preferably rigid and is in one preferred embodiment made of rigid lightweight plastic. Trunk 20 is typically substantially cylindrical in shape and is somewhat wider at the top end 24 of trunk 20 to make it easier for the backboard 70 to easily fit into trunk 20 and easily emerge therefrom. The exact shape of trunk 20 is not limited to be limited to that shown in FIG. 8 or in the other drawings. It is contemplated by the present invention that trunk 20 can have a variety of other shapes as long as it is long enough to accommodate the push rod 50 and pulley system 60 and wide enough on top to allow the backboard to enter and leave and easy enough to be portable and operated as described below. Furthermore, the shape of the top portion of trunk 20 depicted in FIG. 8 is not intended necessarily to be consistent with the shape of the top portion of trunk 20 shown in FIGS. 1-3 or FIGS. 5A and 5B. Furthermore, FIG. 8 is broken away at the top and therefore omits pulley system 60, rotation control device 30, backboard 70 and push rod 50 in and around top end 24 of trunk 20.

In one preferred embodiment, trunk 20 is long and substantially cylindrical throughout its length except for its wider top portion 23.

In a preferred embodiment, the rim 40 is attached to the top portion 23 of the trunk 20 which top portion 23 includes the top end 24 of the trunk 20.

Figure 5A:
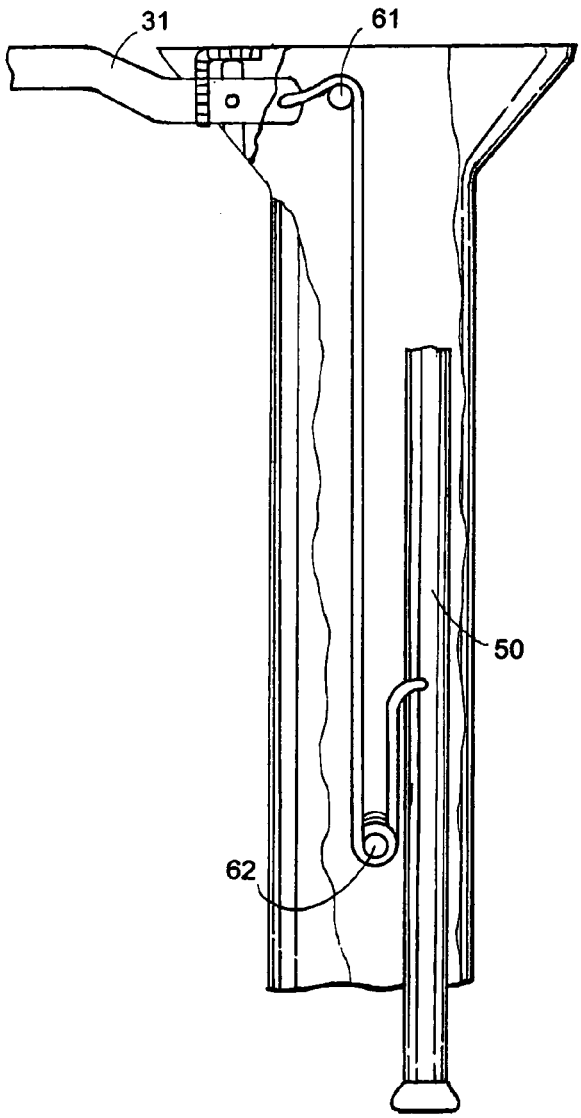
FIG. 5*a* is a front view of the trunk broken away to show the pulley system inside as used in the collapsible basketball backboard assembly of the present invention with the assembly in "open" position.
Figure 5B:
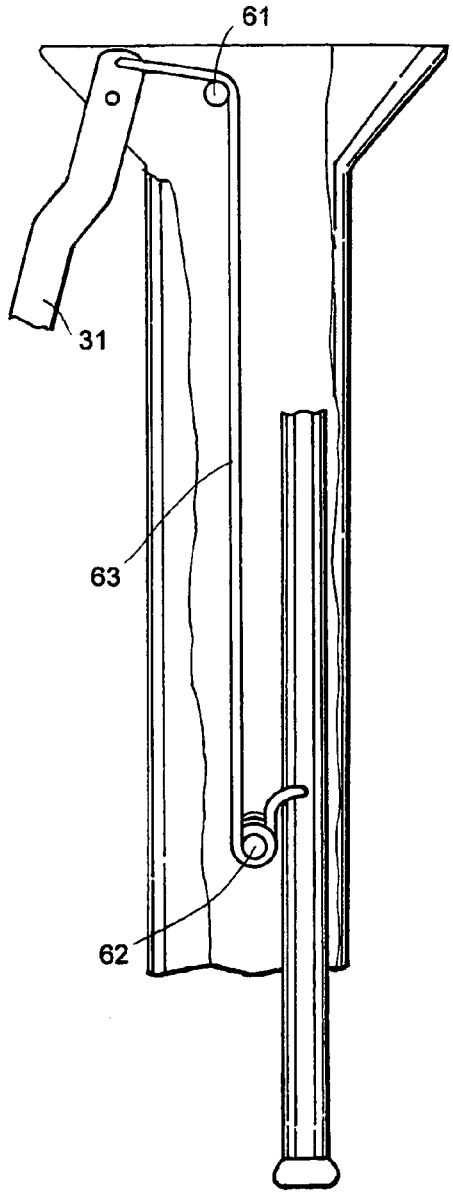
FIG. 5*b* is a front view of the trunk broken away to show the pulley system inside as used in the collapsible basketball backboard assembly of the present invention with the assembly in collapsed position.
Figure 6:
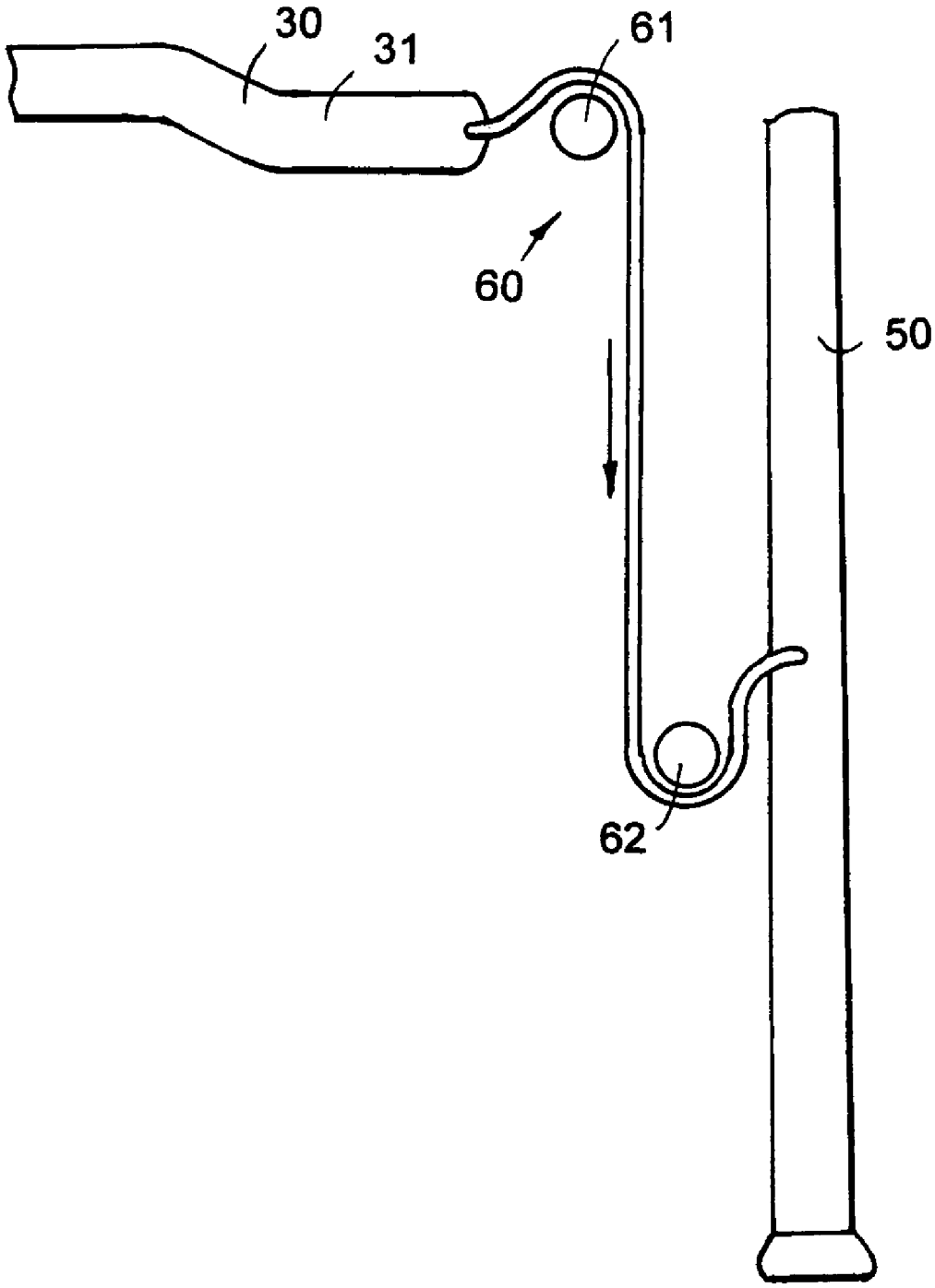
FIG. 6 is a front view of the pulley system and the push rod used in the collapsible basketball backboard assembly of the present invention.
Figure 7:
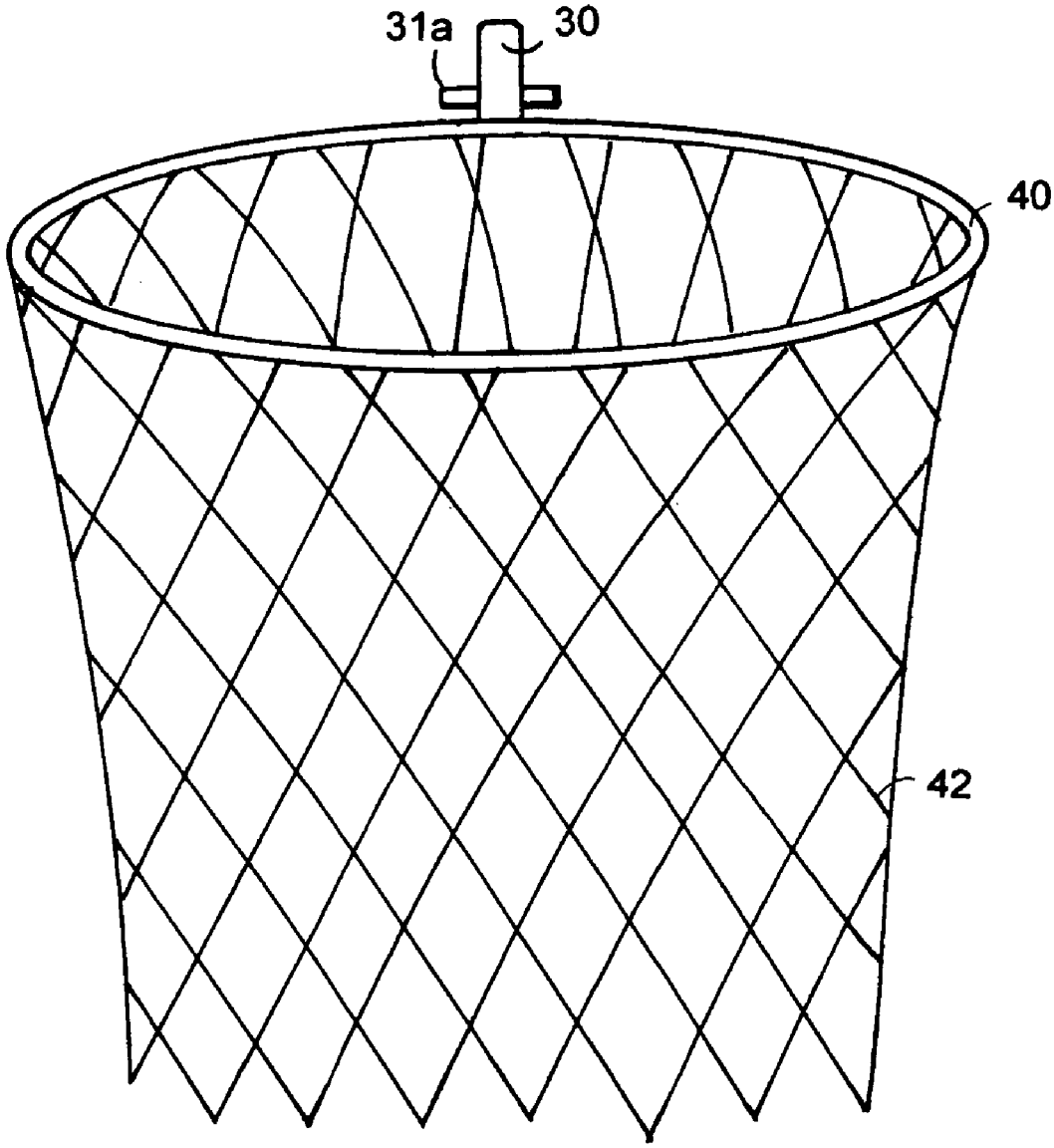
FIG. 7 is a perspective view of the rim and net of the assembly of the present invention.

The rotation control structure 30 is any suitable structure that controls rotation of a rim 40, the rim preferably having a net 42 attached thereto similar to the way nets are attached to basketball rims at the goal area of a basketball game. In one preferred embodiment, the rotation control structure 30 is simply a hinge 31 extending from and rigidly attached to the rim 40 (the rim having an attached net 42). As best shown in FIGS. 5A, 5B and FIG. 6, the hinge 31 includes a horizontal stabilizing pin 31*a*. Each end of this pin fits rotatably into left and right slots in an opening 25 carved out of the top end 24 of trunk 20 and is maintained in stable position using a left bracket and a right bracket located on each side of said opening. Opening 25 is bounded by a left bracket 26*a* and right bracket 26*b*, the left bracket 26*a* adjacent a left slot 26*aa* in the opening 25 and the right bracket 26*b* adjacent a right slot in the opening 25. Alternatively, in this preferred embodiment, the left bracket itself has a left recess and the right bracket itself has a right recess.

It is noted that while right bracket 26*b* appears in FIG. 5A, this right bracket 26*b* is omitted in FIG. 5B for simplicity. In addition, although in FIGS. 5A and 5B push rod 50 appears to be located on the right side of the interior of trunk 20, whereas in FIGS. 1-3 and FIG. 8 push rod 50 appears to be centered within trunk 20, it should be understood that is contemplated by the present invention that push rod 50 can be anywhere within trunk 20 so long as push rod 50 can be pushed and pulled through trunk 20 to operate the present invention in conjunction with pulley system 60 of the present invention and FIGS. 5A and 5B are only intended to depict a schematic illustration of the operation of push rod 50 and pulley system 60 within trunk 20.

Collapsible basketball backboard assembly 20 also includes a push rod 50 inside the trunk 20 substantially throughout the length of trunk 20 and extending out of the bottom end of the trunk 20. In collapsed position, the push rod 50 extends approximately twenty inches out of the trunk 20, whereas in open position the push rod 50 extends only a few inches out of trunk 20 or enough for handle 51 at the lower end of push rod 50 to be grasped.

In one preferred embodiment, the top portion of the push rod 50 includes a push rod assembly 55 that can include a substantially V-shaped structure 58 that connects the common bottom border 72 of the backboard 70 to push rod 50 in a way that transfers the downward force of the push rod 50 to the two halves of the backboard 70 so backboard 70 is forced down into trunk 20 in a single easy motion. Push rod assembly 55 may also include a spring 56 to make the legs of the V-shaped structure operate effectively. It should be emphasized that the present invention definitely is not limited to embodiments having a push rod assembly of the structure depicted in the drawings and contemplates any top portion of push rod 50 that successfully bring the backboard 70 into the trunk 20 and out again upon pulling and pushing of push rod 50.

Collapsible basketball backboard assembly 20 also includes a pulley system 60 inside and attached to the trunk, one end of the pulley system connected to the push rod 50 and another end of the pulley system 60 connected to the rotation control structure 30. Pulley system 60 typically includes two pulley wheels 61, 62 and string 63. Lower wheel 62 has slack of string allowing multiple revolutions of string 63 around lower wheel 62 for the reason that push rod 50 needs to travel close to twenty inches upward when opening assembly 10 prior to pulling string 63 down. This because rotation control structure 30, for example hinge 31, moves much less than twenty inches in order to rotate rim 40 ninety degrees to its "up" position.

In a preferred embodiment, one end of string 63 has been inserted into a hole in hinge 31 and cannot return due to a knot. Any other suitable arrangement for locking string 63 to hinge 31 is also contemplated. The other end of string 63 of pulley system 60 is attached to push rod 50.

Collapsible basketball backboard assembly 20 also includes a basketball backboard 70 comprising parallel planar segments 70*a*, 70*b*, 70*c*, 70*d*, 70*e*, 70*f*, 70*g*, extending from a common bottom border 72 that folds lengthwise, for example in half at common bottom point 72*a*. The segments 70*a*, 70*b*, 70*c*, 70*d*, 70*e* and so on, fit one behind the other when they are collapsed by folding along an imaginary center line bisecting the backboard 70, which imaginary line is parallel to the length of the trunk 20 and crosses the common bottom point 72*a*. The segments 70*a*, 70*b*, 70*c*, 70*d*, 70*e*, 70*f*, 70*g* fan out to form the appearance of one continuous planar basketball backboard 70 when the push rod 50 of assembly 10 is pushed to open and form backboard 70. In a preferred embodiment, though, backboard 70, in open position, is not actually smooth like a real basketball backboard since its segments, 70*a*, 70*b*, 70*c*, 70*d*, 70*e*, 70*f*, 70*g* are at different points of depth within backboard 70 in open position (and certainly in closed position although then they are not visible since they are within trunk 20). Preferably, adjacent segments are at adjacent levels of depth. For example, either segment 70*a* is in front and segment 70*b* is just behind it and segment 70*c* is just behind segment 70*b* and so on, or else the segments are structured in reverse so that segment 70*g* is in front, segment 70*f* is next behind it, segment 70*e* is next behind segment 70*f*, and so on. It should be understood that in the open position the segments are not directly behind one another. As can be seen from FIG. 1, adjacent segments (i.e. 70*a* and 70*b* or 70*b* and 70*c* etc.) of backboard 70 are connected to each other only at common bottom point 72*a*.

Figure 2:
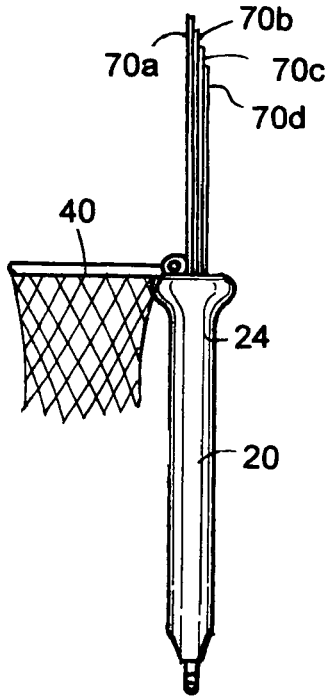
FIG. 2 is a side view thereof.
Figure 4:
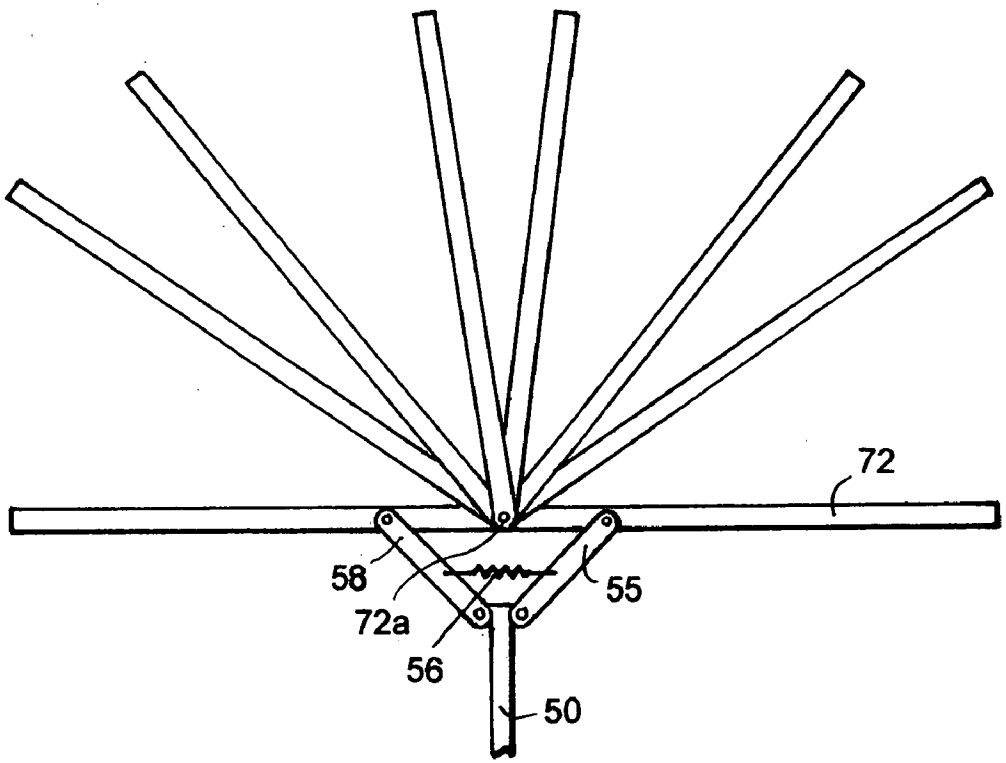
FIG. 4 is a front view of the borders of the segments of the backboard in the backboard assembly of the present invention connected to the common bottom border of the backboard which is connected to the push rod assembly.
Figure 3:
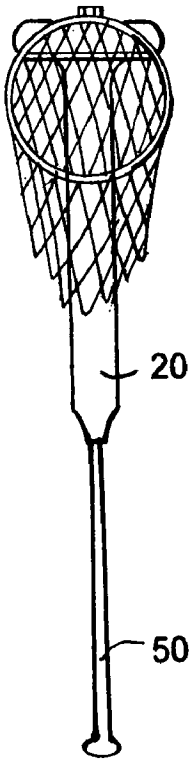
FIG. 3 is a front view of the collapsible basketball backboard assembly of the present invention in a collapsed position.

In should be noted that despite the appearances of FIG. 1 showing planar segments 70*a*, 70*b*, 70*c*, 70*d*, 70*e*, 70*f*, 70*g*, wherein the leftmost and rightmost planar segments 70*a* and 70*g* appear wider than trunk 20, it is understood that in fact all planar segments are narrow enough to fit into trunk 20 in collapsed position and will fit one behind the other, as best shown in FIG. 2. Moreover, although FIG. 2 only appears to depict four segments of backboard 70 one behind the other while FIG. 1 shows seven such segments 70*a*-70*g*, it should be appreciated that FIG. 2 is not intended to show all the segments that may actually be present in the preferred embodiment The present invention also contemplates dividing backboard 70 into a variety of segment shapes to accomplish its purpose including shapes not depicted in the drawings. In this regard, although in a preferred embodiment backboard 70 when opened should resemble the shape of an authentic basketball backboard, it is contemplated by the present invention that variations of this shape can also be used in the assembly 10. In one embodiment, backboard 70 can be divided into triangular planar segments all of equal length and shape.

In addition, the present invention contemplates that the number of planar segments of backboard 70 can be increased or reduced in relation to the seven planar segments depicted in the drawings.

It is noted that in a preferred embodiment the backboard 70 of the assembly 10 of the present invention is typically twenty-four inches in width when opened fully. This is similar to a National Basketball Association regulation size backboard. The present invention contemplates that backboard 70 can be other widths as well, so long as they accomplish the purpose of distracting a basketball player of the opposing team.

As shown in the drawings, a top portion of the push rod 50 is connected to the common bottom border 72 of the basketball backboard 70 so that when the push rod 50 is pulled down to collapse assembly 10 the planar segments 70*a*, 70*b*, 70*c*, and so on, fold and the common bottom border 72 folds at common bottom point 72*a* and backboard 70 enters the hollow space of the trunk 20. At the same time, rim 40 falls or rotates downwardly by ninety degrees so that said rim 40 is substantially parallel to the trunk 20 and is alongside an outer wall of said trunk 20. Then when push rod 50 is pushed upward to open assembly 10, the backboard 70 opens and the rim 40 rotates ninety degrees upward so that said rim 40 is substantially perpendicular to the length of trunk 20.

In operation, the fan would typically be positioned behind the goal area of a basketball stadium and when the opposing team's player is concentrating on a free throw, the fan would grasp assembly and push push rod 50 upward thereby opening backboard 70 and rotating rim 40 into position. It may be necessary to grip the top part of the trunk with one hand to make it easier to push the push rod 50 forcefully. In certain preferred embodiments trunk 20 has a sufficiently small diameter that a hand to grasp and substantially surround trunk 20. Alternatively, the assembly 10 of the present invention contemplates having a piece 29 of the trunk housing 20 projecting outward from an otherwise smooth outer surface of trunk 20 in order to make it easier for a fan holding device 10 to grip the trunk 20 with one hand while pushing the push rid 50 with the other hand. Alternatively, a recess in the housing of trunk 20 can make it easier to grasp trunk 20.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A collapsible basketball backboard assembly, comprising:

a hollow trunk having a bottom end and a top end, the top end having a groove a push rod inside the trunk substantially throughout its length and extending out of the bottom end of the trunk, a hinge having rigidly attached thereto a rim with a net, the hinge fitting rotatably into the groove a pulley system inside and attached to the trunk for controlling rotation of the hinge, one end of the pulley system connected to the push rod and another end of the pulley system connected to the hinge, a basketball backboard comprising parallel substantially planar segments extending from a common bottom border, the common bottom border being foldable lengthwise, the segments fitting one behind the other when the assembly is in collapsed position, the segments, fanning out to form the backboard when the assembly is in open position, a top portion of the push rod connected to the common bottom border of the basketball backboard so that when the push rod is pulled down the planar segments and bottom border fold and enter the hollow space of the trunk and the rim falls, and when the push rod is pushed, the backboard opens and the rim rotates so that it is substantially perpendicular to the trunk.

2. The collapsible basketball backboard assembly of claim 1, wherein the trunk is rigid.

3. The collapsible basketball backboard assembly of claim 1, wherein the push rod has a lower end extending out of the trunk, said lower end including a handle.

4. The collapsible basketball backboard assembly of claim 1, wherein the pulley system has a lower wheel and an upper wheel, the lower wheel holding multiple revolutions of string when the assembly is in a collapsed position.

5. The collapsible basketball backboard assembly of claim 1, wherein the planar segments meet at a common bottom point along the common bottom border.

6. A collapsible basketball backboard assembly, comprising:

a rim having an attached net, a hollow trunk having a bottom end and a top portion, the top portion attached to a rotation control structure that controls rotation of the rim, a push rod inside the trunk, said push rod extending out of the bottom end of the trunk, a pulley system inside and attached to the trunk, one end of the pulley system connected to the push rod and another end of the pulley system connected to the rotation control structure, a basketball backboard comprising substantially parallel planar segments, the segments fitting one behind the other when the assembly is in collapsed position, the segments fanning out to form the basketball backboard when the assembly is in open position, a top portion of the push rod connected to the basketball backboard so that when the push rod is pulled down the planar segments fold and enter the hollow space of the trunk and the rim falls, and so that when the push rod is pushed, the basketball backboard opens and the rim rotates so that said rim is substantially perpendicular to the trunk.

7. The collapsible basketball backboard assembly of claim 6, wherein the parallel planar segments extend from a common bottom border, the common bottom border being foldable lengthwise.

8. The collapsible basketball backboard assembly of claim 7, wherein the top portion of the push rod is connected to the common bottom border.

9. The collapsible basketball backboard assembly of claim 6, wherein the push rod inside the trunk is substantially throughout a length of said trunk.

10. The collapsible basketball backboard assembly of claim 6, wherein the top portion of the push rod includes a push rod assembly.

11. The collapsible basketball backboard assembly of claim 6, wherein the push rod assembly includes a V-shaped structure that connects the common bottom border of the basketball backboard to the push rod.

12. The collapsible basketball backboard assembly of claim 6, wherein the push rod assembly also includes a spring.

13. The collapsible basketball backboard assembly of claim 6, wherein the trunk is rigid.

14. The collapsible basketball backboard assembly of claim 6, wherein the push rod has a lower end extending out of the trunk, said lower end including a handle.

15. A method of distracting a player of a sports game by utilizing the device of claim 1 or claim 6 comprising:

holding a collapsed basketball backboard assembly that comprises a rim having an attached net, a hollow trunk having a bottom end and a top portion, the top portion attached to a rotation control structure that controls rotation of the rim, a push rod inside the trunk and accessible to a user, a pulley system inside and attached to the trunk and connected to the push rod and the rotation control structure, a basketball backboard comprising substantially parallel planar segments positioned inside the trunk in a collapsed position, a top portion of the push rod connected to the basketball backboard;

pushing the push rod so that the segments fan out to form the basketball backboard and so that the rim rotates so as to be substantially perpendicular to the trunk; and waving the basketball backboard assembly within view of the player.

* * * * *